United States Patent [19]

Graham

[11] 4,099,356

[45] Jul. 11, 1978

[54] SEAMED RIB PANEL ASSEMBLY

[75] Inventor: Hubert P. Graham, Fort Mill, S.C.

[73] Assignee: Alcan Aluminum Corporation, Cleveland, Ohio

[21] Appl. No.: 730,158

[22] Filed: Oct. 7, 1976

[51] Int. Cl.[2] ..... E04D 1/30; E04D 3/362

[52] U.S. Cl. ..... 52/520; 52/276; 52/528; 52/539

[58] Field of Search ..... 52/520, 528, 536, 537, 52/539, 276, 588

[56] References Cited

U.S. PATENT DOCUMENTS

| | | | |
|---|---|---|---|
| 2,076,388 | 4/1937 | Venzie | 52/588 X |
| 3,312,028 | 4/1967 | Schroyer | 52/478 |
| 3,411,251 | 11/1968 | Corry | 52/520 X |
| 3,555,758 | 1/1971 | Schroter | 52/478 X |
| 3,606,718 | 9/1971 | Curran | 52/588 X |
| 3,858,373 | 1/1975 | Day et al. | 52/520 X |
| 3,898,783 | 8/1975 | Matlock et al. | 52/588 |
| 3,998,019 | 12/1976 | Reinwall, Jr. | 52/520 |

*Primary Examiner*—Alfred C. Perham
*Attorney, Agent, or Firm*—Cooper, Dunham, Clark, Griffin & Moran

[57] ABSTRACT

An assembly of metal panels for a building or the like, wherein adjacent panels have outwardly projecting side flanges interlocked to constitute a seamed rib, and including anchor clips mounted on supporting structure and held in the seamed rib between the interlocked flanges for securing the panels to the structure. The outer portions of the panel flanges are formed as longitudinal box channels all opening in the same lateral direction and dimensioned to interfit in nesting relation, while the clips similarly have portions formed as box channels that fit between the nested channels of the interlocked flanges. The channel-formed portion of each panel flange has an outer leg formed with a return curve; for ease of assembly, the return curve on the outermost flange of each seamed rib is initially partly open, and is deformed after assembly so as to conform closely to the return curve of the inner flange of the rib.

3 Claims, 5 Drawing Figures

Fig. 1.
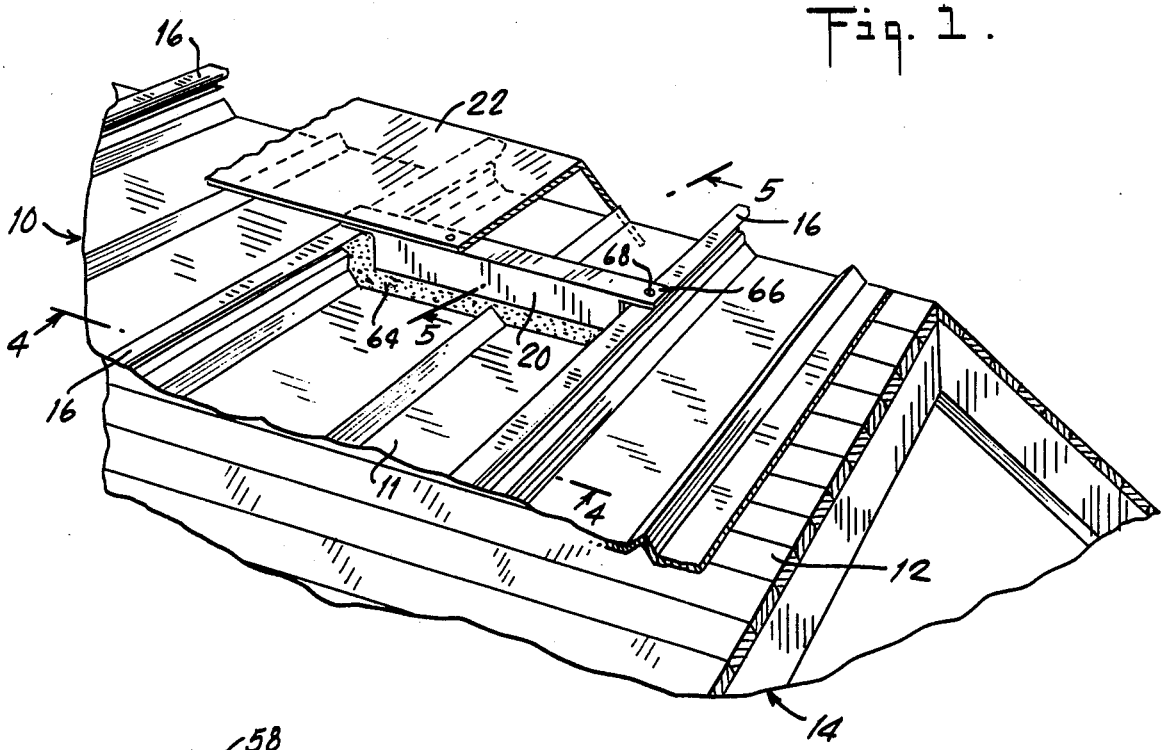
Fig. 3.
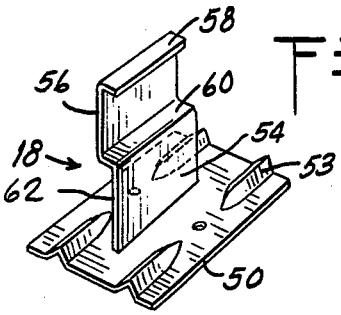
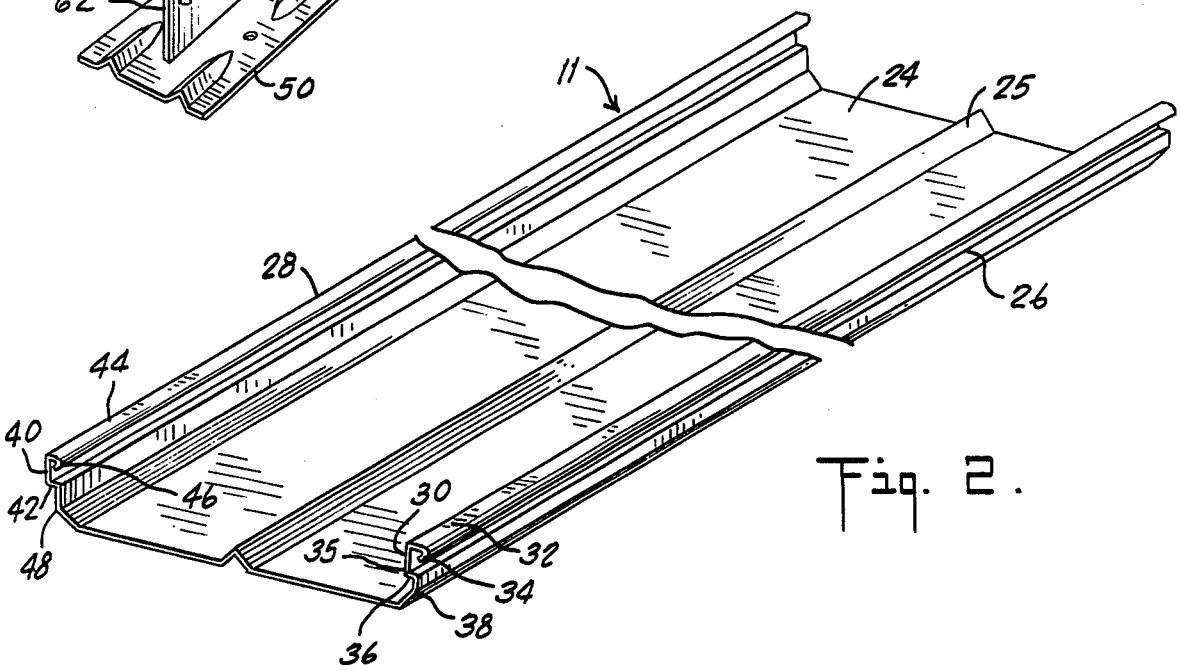
Fig. 2.

SEAMED RIB PANEL ASSEMBLY

BACKGROUND OF THE INVENTION

This invention relates to assemblies of metal panels for buildings or the like, such as are used for walls or roofs, and to methods of making such assemblies. More particularly, the invention is directed to metal panel assemblies which are interlocked along so-called seamed ribs and are secured to supporting structure by means fo anchor clips held within the seams.

In the building arts, it is known to provide aluminum or other metal panel siding or roofing wherein adjacent, parallel, elongated panels are interlocked by engagement of side flanges of the panels with each other, so as to inhibit penetration of moisture and to prevent dislocation of the panels by wind. One known type of interlocking panel has parallel outwardly projecting flanges along its sides, each having a laterally opening longitudinal box channel formed therein; as used herein, the term "box channel" refers to a channel with parallel flat legs perpendicular to the central web. The channels of both side flanges of the panel open in the same directions, and are of such relative dimensions that the channel-formed portion of one flange of one panel fits nestingly within the channel of the facing flange of an adjacent panel, i.e. when the panels are assembled in side-by-side relation on a wall or roof. The outer legs of the two channels of each panel having conforming return curves which cooperate with the nested channel-formed portions to interlock the assembled panels. Such panels are readily assembled, and interlock satisfactorily; however, it is necessary to secure them to the supporting structure, and if this is done in conventional manner as with nails or other fasteners projecting through the panels, leakage of moisture may occur at the locations of the fasteners.

It has also been proposed to provide assemblies of panels having outwardly projecting longitudinal side flanges with their outer portions shaped to form cylindrical beads, wherein the beads on opposite side flanges of a panel respectively open in opposite directions. These beads are so dimensioned as to interfit when the panels are assembled; i.e. the bead on one side flange of one panel fits within the bead on the proximate side flange of the adjacent panel. To enable such assembly, the larger of the two beads of each panel is left partially open until it receives the smaller bead of the adjacent panel, and is then closed (over the smaller bead) by a rolling device sometimes called a seaming tool, to form a seamed rib interlocking the adjacent panels. At intervals along the rib, anchor members mounted on the underlying support structure are held within the ribs to secure the panel assembly to the support structure without penetration of the panels by fastening elements; each of these members has an outward projection that extends between the two rib-forming flanges and terminates in a cylindrical bead interfitted between the two beads that constitute the rib. Assemblies of this type are disclosed in U.S. Pat. Nos. 3,312,028 and 3,555,758.

SUMMARY OF THE INVENTION

The present invention contemplates the provision of a metal panel assembly comprising, in combination with supporting structure, a side-by-side parallel array of metal panels of the above-described type having flanges with nestingly interfitting longitudinal box channels opening in the same direction and having outer legs with conforming return curves, so as to form seamed ribs for interlocking the panels; and a plurality of anchor clips spaced along each seamed rib for securing the panel array to the supporting structure, each of the clips comprising a base mounted on the structure and an outward projection having an outer portion formed as a box channel conforming to, and interfitted nestingly between, the channel-formed portions of the two panel flanges constituting the rib along which the clip is disposed. The clip channel has a flat outer leg disposed between, but terminating short of the return-curve portions of, the outer legs of the last-mentioned flanges. The channel-formed portions of the flanges and clip are spaced outwardly of the central webs of the panels, and are mutually so dimensioned that the clip channel legs snugly grip one of the two flange channels constituting the rib, while the legs of the other of the two flange channels snugly grip the clip channel.

In assembling this panel system, the clips are first mounted in appropriately positioned rows on the support structure, and the panels are assembled thereon. To facilitate such assembly, the return curves of the outer legs of those panel flanges which are to lie on the outside of the seamed ribs are initially formed with radii larger than the radii of the return curves of the outer legs of the other flanges. After the panels are assembled, these larger-radii outer legs are deformed as with a seaming tool to complete the closure of the seamed ribs.

One advantage of the described structure is that both legs of each of the flange and clip channels cooperate in achieving secure gripping engagement between the panel flanges and the clips in each seamed rib. That is to say, there are two locking surfaces, parallel to the plane of the central web of each panel, affording a superior locking effect (and providing positive anchorage of the panels during installation, i.e. prior to the final seaming operation) while accommodating thermal expansion and contraction of the panels. Another advantage resides in the facility with which a seamed rib of the described box-channel configuration, once closed with a seaming tool, may be reopened e.g. if necessary to correct a failure to properly secure a clip.

A still further advantage of the invention resides in the fact that closure elements may readily be mounted on the assembly without penetration of the panels by fasteners in a way that might cause leakage through the panels. Such closure elements, e.g. ridge closures, are commonly employed with panel assemblies having raised ribs to act as dams or seals against wind-driven moisture. Typically, the closure element is mounted within and adjacent one end of a panel, filling the full width of the panel to prevent passage of moisture. In the present seamed rib construction, the overlying flange outer leg of each seamed rib provides a flat outer rib surface to which end extensions of a ridge closure may be secured (e.g. by means of screws or other fasteners) without penetrating the panel web.

Further features and advantages of the invention will be apparent from the detailed description hereinbelow set forth, together with the accompanying drawings.

BRIEF DESCRIPTION OF THE DRAWINGS

FIG. 1 is a fragmentary perspective view of a roof panel assembly embodying the present invention in a particular form;

FIG. 2 is a fragmentary perspective view of one panel of the FIG. 1 assembly;

FIG. 3 is a perspective view of one anchor clips of the FIG. 1 assembly;

DETAILED DESCRIPTION

Figure 4:
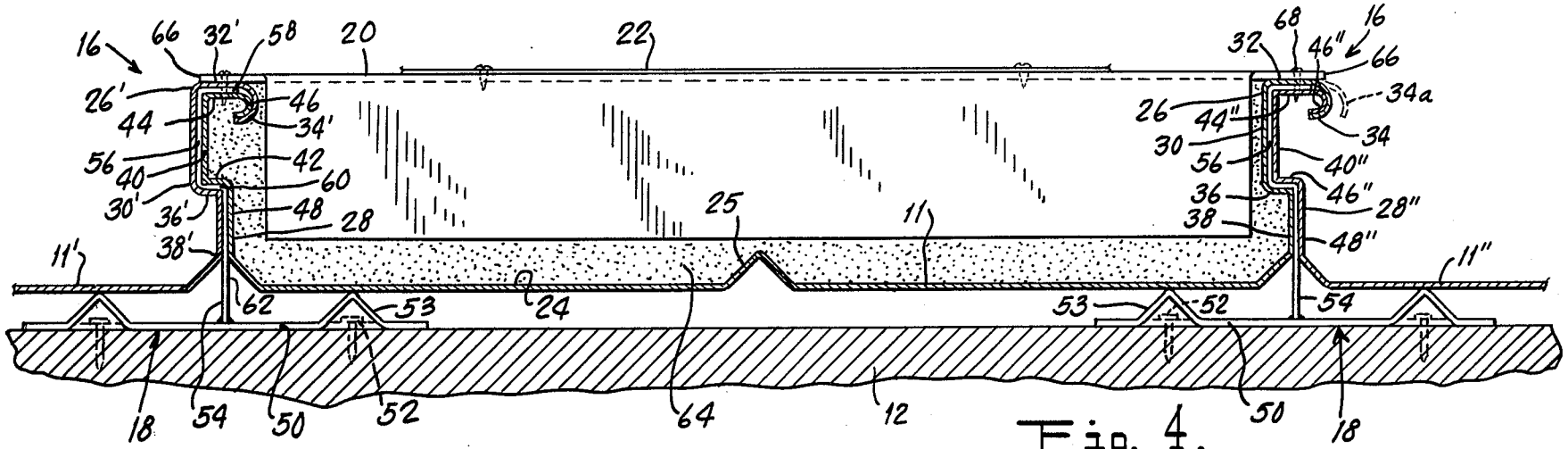
FIG. 4 is an enlarged sectional view taken along the line 4—4 of FIG. 1.

Referring to the drawings, the invention is illustrated as embodied in an assembly 10 of elongated aluminum roofing panels 11, mounted on supporting wooden substructure 12 of the roof of a building 14. The assembly comprises a parallel, side-by-side array of the panels 10, interlocked at seamed ribs 16 intermediate each pair of adjacent panels, and secured to the supporting structure 12 by means of a plurality of anchor clips 18. In addition, the assembly is shown as incorporating a ridge closure 20 over which is mounted an inverted V-shaped flashing 22.

Each of the panels 11 is fabricated of roll-formed sheet aluminum strip, having a central web 24 with a central V-shaped longitudinal stiffening rib 25. The two side edges of the panel are bent outwardly to constitute first and second outwardly projecting longitudinal flanges respectively designated 26 and 28 and respectively disposed on opposite sides of the web 24. It will be understood that the terms "outwardly" (or "outer") and "inwardly" (or "inner"), as used herein, respectively refer to directions away from and toward the supporting structure 12 which the panel assembly overlies.

The outer portion of the first flange 26 is formed as a longitudinal box channel 30 opening laterally in a direction away from the second flange, and having a generally planar outer leg 32 (parallel to the plane of the central web 24) which is formed along its margin with a return curve 34. The web 35 of channel 30 lies in a plane perpendicular to the panel central web 24, while the inner leg 36 of the channel is parallel to but shorter than the outer leg 32. The inner portion 38 of flange 26 extends inwardly from leg 36, first in a direction perpendicular thereto, and then slopes toward the center of the panel to join the central web 24.

The second flange 28 is of the same configuration as flange 26 described above, having its outer portion formed as a longitudinal box channel 40 opening laterally toward flange 26 (i.e. in the same direction as channel 30) with a short inner leg 42 and an extended outer leg 44 terminating in a return curve 46. Like the channel 30, channel 40 is spaced outwardly from the panel central web 24 by an inner flange portion 48 which is a mirror image of portion 38 of flange 26. Howver, the channel-formed portion 40 of flange 28 is dimensioned and positoned to fit nestingly within the channel 30' of the first flange 26' of a panel 11' (identical to panel 11) disposed in contiguous side-by-side relation to panel 11, while channel 30 is dimensioned and positioned to receive, in nesting relation, the channel-formed portion 40'' of the second flange 28'' of a further panel 11'' lying on the side of panel 11 opposite to panel 11', all as shown in FIG. 4.

As further illustrated in FIG. 4, when the second-flange channel 40 of panel 11 is fitted nestingly within the first-flange channel 30' of the adjacent panel 11', both channels open in the same direction, with the channel 30' surrounding and overlying the channel 40, and with the return curve 34' of the outer leg 32' of channel 30' overlying the return curve 46 of the outer leg 44 of channel 40 in closely conforming relation thereto, so that the two flanges 26' and 28 with their interfitted channels 30' and 40 together comprise an upstanding seamed rib 16 extending between, and interlocking, the two adjacent panels 11' and 11. Similarly, on the other side of panel 11, the two flanges 26 and 28'' with their interfitted channels 30 and 40'' together constitute another seamed rib 16 interlocking the adjacent panels 11 and 11''.

By way of specific example, the overall width of one panel 11 may be approximately 12 inches, and the height of the seamed rib (measured from the panel web) may be 2¼ inches.

The panels 11 as thus far described are generally of a type heretofore known and used, as mentiond above, having flanges with nestingly interfitted box channels and closely conforming return curves on the outer legs of the channels to provide a secure interlock between panels. However, in the case of the panels employed in the assembly of the present invention, the outer leg 32 of the first flange 26 is initially formed with a return curve 34 having a radius of curvature substantially greater than that of the return curve 46 of leg 44 of the second flange 28, to facilitate assembly as hereinafter explained. This initial configuration of leg 32 is indicated in broken lines at 34a in FIG. 4. As further explained below, after the panels are assembled the leg 32 is deformed to its final return curve configuration (illustrated in solid lines in FIG. 4) to complete the interlocking of adjacent panels. Also, in the panels employed in the present invention, the inner dimension of channel 30 and the outer dimension of channel 40 are mutually selected to accommodate portions of the anchor clips 18 between them, as will now be described.

Important features of the invention reside in the configuration of the anchor clips 18 for securing the assembly of panels to the supporting structure 12, and in the combination of these anchor clips with the above-described panels. As best seen in FIGS. 3 and 4, each of these clips 18 is a metal structure having a generally flat base 50 mounted on the supporting structure 12 with suitable and e.g. conventional fastening elements such as screws 52. The base has raised portions 53 to provide clearance (e.g. about one fourth inch) between the structure 12, the panels, and the screws. The clip further includes an upstanding projection 54 which extends outwardly from the base and has an outer portion formed as a box channel 56 positioned and dimensioned to fit nestingly between the second-flange channel 40 of one pannel 11 and the first-flange channel 30' of a second, adjacent panel 11', i.e. when the two flange channels are fitted together to constitute a seamed rib 16. The flat outer leg 58 of clip channel 56 then lies between the outer legs 44 and 32' of the two flange channels, but terminates inwardly of the return curves 46 and 34' thereof, while the inner leg 60 of channel 56 lies between the inner legs of the two flange channels, and the inner portions 62 of the clip projection 54 (between the channel 56 and the base 50) extends between the inner portions 48 and 38' of the two panel flanges 28 and 26'. The relative dimensions of channels 40, 56, and 30' are such that the flange channel 40 is snugly gripped between the two legs 58 and 60 of the clip channel 56, which is in turn snugly gripped between the two legs 32' and 36' of the flange channel 30'.

The clips 18 are mounted on the structure 12 in a plurality of parallel rows, corresponding in number and position to the plural seamed ribs 16 of the panel assembly. Each of these rows includes a plurality of clips, spaced apart along the row, and oriented for fitting between the interlocked flanges of adjacent panels in the manner described above.

In the installation of the assembly 10, the clips are first mounted on the structure 12. The panels 11 (having the outer legs 32 of their flanges 26 bent in the initial open configuration shown at 34*a* in FIG. 4) are then fitted in succession on the clips; the initial shape 34*a* of the flange outer legs 32 provide the ncessary clearance to facilitate this assembly step, while the gripping engagement of the clip and flange channel legs positively holds the panels in place during the assembly step. Finally, the return curves 34 of the flange outer legs 32 are deformed, into conformity with the return curves 46 of the underlying flange outer legs 44, by advancing a generally conventional motor-operated seaming tool (not shown) along each seam.

Figure 5:
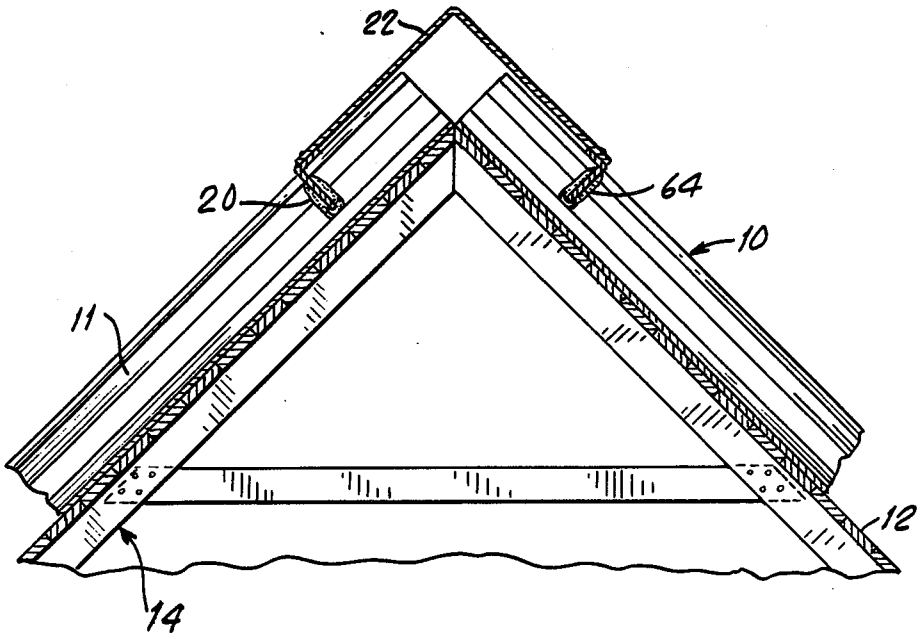
FIG. 5 is a sectional view taken along the line 5—5 of FIG. 1.

When the assembly of panels is complete, closure members such as the ridge closure 20 shown in FIGS. 1, 4 and 5 may be mounted thereon. This closure 20 is a metal member dimensioned to bridge the width of one panel 11, and bears a polyethylene filler or seal 64 which conforms to the panel profile to provide a moisture-tight barrier. End extensions 66 of the closure 20 overlie the two seamed ribs 16 on each side of the panel 11, and are secured thereto with screws 68 to hold the closure in place. The flatness of the seamed rib outer surfaces facilitates such attachment. Flashing 22 may then also be mounted on the assembly.

It is to be understood that the invention is not limited to the features and embodiments hereinabove specifically set forth, but may be carried out in other ways without departure from its spirit.

I claim:

1. A panel assembly for buildings and the like comprising, in combination with structure for supporting the assembly, (a) an array of elongated metal panels disposed in parallel side-by-side relation outwardly of said structure, each of said panels having first and second longitudinal flanges respectively projecting outwardly along opposite sides thereof, the first flange of each panel having an outer portion formed as a longitudinal box channel opening laterally away from the panel, the second flange of each panel having an outer portion formed as a longitudinal box channel fitted within and opening in the same direction as the channel of the first flange of the next adjacent panel in the array, the channel-formed portion of each flange having a flat outer leg with a free longitudinal margin formed with a return curve, and the return curve of the outer leg on each said first flange closely and conformably overlying the return curve of the outer leg of the adjacent-panel second flange fitted therein, the interfitted channel-formed portions of the first and second flanges of adjacent panels comprising a seamed rib for interlocking the panels, such that there is a seamed rib between each pair of adjacent panels in the array; and (b) a plurality of metal anchor clips spaced along each said seamed rib for securing the array to said structure, each of said clips comprising a base mounted on the structure and an outward projection having an outer portion formed as a box channel conforming to, and interfitted nestingly between, the channel-formed portions of the interfitted first and second flanges constituting the seamed rib along which the clip is disposed;

(c) the channel-formed portion of the clip projection having a planar outer leg disposed between, but terminating short of the return curves of, the outer legs of the last-mentioned first and second flanges;

(d) the channel-formed portion of each flange having an inner leg parallel to the outer leg thereof, the channel-formed portion of each clip outward projection having an inner leg parallel to the outer leg thereof, and the channel-formed portions of the flanges and of the clip projection being mutually so dimensioned that the channel-formed portion of the second flange is snugly gripped between the legs of the clip projection and the channel-formed portion of the clip projection is snugly gripped between the legs of the first flange.

2. An assembly as defined in claim 1, wherein each panel has a central web; wherein the channel-formed portion of each of said flanges is spaced outwardly of the panel web; wherein each of said flanges has an upstanding inner portion extending from the channel-formed portion to the web; and wherein each of said clip projections has a flat upstanding inner portion extending, from the channel-formed portion to the clip base, between the upstanding inner portions of the first and second flanges of adjacent panels between which the clip is disposed.

3. An assembly as defined in claim 1, wherein the outer leg of the channel-formed portion of each first flange provides a flat outer surface of the seamed rib which it comprises; and further including at least one closure member, said one closure member extending across the width of a panel of the array between the first and second flanges thereof and having opposite end extensions respectively overlying, and secured to, the flat outer surfaces of the seamed ribs on opposite sides of the last-mentioned panel.

* * * * *